US006033512A

United States Patent [19]

Coco et al.

[11] Patent Number: 6,033,512

[45] Date of Patent: Mar. 7, 2000

[54] VENETIAN BLIND TAPE AND METHOD OF MANUFACTURE THEREOF

[75] Inventors: Lewis M. Coco, South Dartmouth; Michael J. Sitarz, North Dartmouth; Thomas P. Kefor, Norton, all of Mass.

[73] Assignee: Julius Koch USA, Inc., New Bedford, Mass.

[21] Appl. No.: 09/076,774

[22] Filed: May 12, 1998

[51] Int. Cl.[7] ..... B44C 1/165; E06B 9/26; E06B 9/36; D06C 13/06

[52] U.S. Cl. ..... 156/230; 156/65; 156/238; 156/240; 26/11.4; 160/900

[58] Field of Search ..... 156/65, 230, 240, 156/238, 241, 247, 277, 289; 139/384 A; 26/11.4; 160/34, 166.1, 900; 425/DIG. 61; 6/577

[56] References Cited

U.S. PATENT DOCUMENTS

| | | | |
|---|---|---|---|
| 291,222 | 1/1984 | Phillips | 160/168.1 |
| 4,315,790 | 2/1982 | Rattee et al. | 156/230 |

*Primary Examiner*—Richard Crispino
*Assistant Examiner*—J. A. Lorengo
*Attorney, Agent, or Firm*—Cantor Colburn LLP

[57] ABSTRACT

A method of manufacturing and coloring a two tone Venetian blind tape is provided. The two tone Venetian blind tape is particularly adapted to be used in a Venetian blind having a succession of colored slats wherein the surfaces of one side of the slats are of a light color or substantially neutral, i.e., white or off-white and the surfaces on the reverse side of the slats are of any decorator color or pattern or contrasting color. In accordance with the present invention, the outer surface of the face fabric of the Venetian blind assembly is colored with a decorative color and/or pattern or in an alternative embodiment a decorative pattern may be applied to the outer surface of a pre-dyed face fabric by means of a thermal transfer printing process. The color or decorative pattern which is desired to be applied to the outer surface of the face fabric is provided on a conventional heat sensitive printing paper. In one embodiment, by utilizing a thermal transfer printing process, the outer surface of the face fabric can be finished in a desired color and/or decorative pattern, while leaving the back fabric in the natural (white) color or in the alternative embodiment the decorative pattern is applied to the colored outer surface of the face fabric, while leaving the back fabric colored.

19 Claims, 3 Drawing Sheets

VENETIAN BLIND TAPE AND METHOD OF MANUFACTURE THEREOF

BACKGROUND OF THE INVENTION

1. Field of the Invention

This invention relates generally to Venetian blinds and methods of manufacture thereof. More particularly, this invention relates to a novel two tone Venetian blind tape which allows the front (interior) face of the blind to have any decorative color or pattern applied while the back surface of the blind will have a neutral color exposed.

2. Brief Discussion of the Prior Art

It is known in the Venetian blind art to provide blinds having slats of different colors. Thus, slats having one color and/or design on one side and another color and/or design on the reverse side have been used, particularly where decorator colors are desired to enhance the appearance of a room or office.

When colored slats are employed, it is generally desired to have the colored portion appear primarily on the inside of the room, the outside of the blind being of a light, neutral, off-white or pastel color so that when the building is viewed from the outside all blinds will be of a uniform color, although flexibility of color decor is retained on the inside of the blind.

It is also known that architects and building owners, desiring to have a uniform outside appearance of a building or wishing to match various structural portions of the building, or to create a distinctive body of color for a portion of the building, will specify that a certain color be included on the exterior exposed surfaces of the blinds.

In the past, it has also been known to use with colored slats a "string" type supporting ladder of the same color as the contrasting colored surfaces of the slats. However, when one side of the strings of the ladder is colored and the faces of the slats contacting the same are of another color or substantially white or off-white, it has been found that there is a tendency for the color in the ladders to migrate to the light colored surfaces of the slats and discolor the same, either during the use or shipping when the ladder strings are bunched up. This obviously results in an unsightly appearance if the blind is reversed for any reason or if the blind is closely viewed from the outside of the building, as for example from a patio, the front of a house or a street level window in a commercial establishment. Also, the appearance of a colored ladder against a different outside color is objectionable.

In view of the foregoing problem, it became customary practice to use white ladders, regardless of the color decor on the slats, which is often objectionable to decorators who wish the blind generally to present the appearance of one continuous color or at least not show a pronounced vertical white string or stripe which may interfere with the decor of the room.

By providing a Venetian blind having a succession of colored slats wherein the surfaces of one side of the slats are of a light color or substantially neutral, i.e. white or off-white, and the surfaces on the reverse side of the slats are of a darker contrasting color and which employs string ladders which are so colored as to blend with each of the colored surfaces of the slats, respectively, and render the strings substantially unnoticeable when the blind is in a closed or partially closed position.

More specifically, only one side of each set of the vertical strings is colored, preferably with a matching color or color which will blend with the color generally exposed to the side of the window to which the color is desired; and the other opposed set of vertical strings are of a light color or substantially white. This permits the blind to meet the requirements of decorators and architects with respect to the inside of the room or outside of the building.

In the prior art of U.S. Pat. No. 4,336,834, the Venetian blind ladder is of the type that is known in the trade as a "string" ladder. The base materials of the ladder are a front and rear vertical supporting members of the ladder. The vertical members are cord-like and are preferably braided. Inserted at predetermined areas are crossladder members which are comprised of a plurality of separate string-like or threadlike strands which lie along side of one another and are interwoven with the vertical supporting members. These crossladder members become members which support the slat material of the venetian blind.

Although the crossladder of U.S. Pat. No. 4,336,834 is quite suitably for its intended purpose, there is a perceived need for a more decorative and improved Venetian blind "crossladder" design in the form of a tape, wherein the vertical members comprise two shreds of narrow fabric instead of the cord-like members of U.S. Pat. No. 4,336,834.

SUMMARY OF THE INVENTION

The above-described drawbacks and deficiencies of the prior art are alleviated by the Venetian blind tape and method of manufacture of the present invention, wherein a two tone Venetian blind tape is provided. In one embodiment, the two tone Venetian blind tape is particularly adapted to be used in a Venetian blind having a succession of colored slats wherein the surfaces of one side of the slats are of a light color or substantially neutral, i.e., white or off-white and the surfaces on the reverse side of the slats are of any decorator color or pattern or contrasting color. In another embodiment, the two tone Venetian blind tape is particularly adapted to be used in a Venetian blind having a succession of colored slats wherein the surfaces of one side of the slats are of one color and the surfaces on the reverse side of the slats are of the same or different decorative color. The base material is a stock Venetian blind tape material comprising two fabrics: a face fabric and a back fabric, both of which become the vertical members of the Venetian blind tape. Inserted at predetermined lengths are "cross-rung" members which comprise yarns. The cross-rung members become the support members for the slat material of the Venetian blind. As used herein the term "stock Venetian blind tape material" refers to tape material in which the cross-over threads have not been cut.

In accordance with one embodiment of the present invention, the face fabric of the stock Venetian blind tape material comprises a fabric having an outer surface and an inner surface wherein the outer surface is colored with any decorative color and/or pattern and the inner surface is not colored and remains a light color or substantially neutral in color. More specifically, only the outer surface of the face fabric is colored, preferably with a matching color or decorative pattern which will blend with the color generally exposed to the side of the window to which the color is desired; and the other opposed fabric (the back fabric) is of a light color or substantially white. In another embodiment the face fabric and back fabric are pre-dyed with a color and a decorative pattern is provided on the outer surface of the colored face fabric in accordance with the method of the present invention. In this embodiment, the color of the front fabric and the back fabric are preferably of the same color.

In accordance with the method of the present invention, stock Venetian blind tape material is provided at an infeed station prior to being delivered to a thermal transfer printing station. Prior to delivery of the stock Venetian blind tape material to the thermal transfer printing station, the threads in the cross-over area remain uncut so that the material is not allowed to hinge open. More specifically, one vertical member is prevented from hinging open relative to the other member by way of a hinging motion of the cross-rung members and therefore when the stock Venetian blind tape material is delivered to the thermal transfer printing process, significant sliding of the one vertical member relative to the other is alleviated. Using stock Venetian tape material provides for increased dimensional stability of the tape material as it is introduced to the thermal transfer printing station, and maintaining such stability is important in the end use of the Venetian blind tape in a Venetian blind. The uncut tape material is then delivered to the thermal transfer printing station by use of conventional tension rollers and guide units known in the art.

In accordance with the present invention, the outer surface of the face fabric of the Venetian blind assembly is colored with a decorative color or in an alternative embodiment a decorative pattern by means of a thermal transfer printing process. The color and/or decorative pattern which is desired to be applied to the outer surface of the face fabric is provided on conventional heat sensitive printing paper. It is within the scope of this invention, that any colors or patterns that may be provided on such heat sensitive printing paper are suitable for use in the present invention. By utilizing a thermal transfer printing process, the outer surface of the face fabric can be finished in a desired color and/or decorative pattern, while leaving the back fabric in the natural (white) color or in an alternative embodiment in a selected color.

The invention will be better understood by the following description of the preferred embodiment thereof in relation to the accompanying drawings of which the following is a brief description, and wherein the dimensions are exaggerated in some instances for illustrative purposes.

BRIEF DESCRIPTION OF THE DRAWINGS

Referring now to the drawings wherein like elements are numbered alike in the several FIGURES.

DETAILED DESCRIPTION OF THE INVENTION

Figure 1:
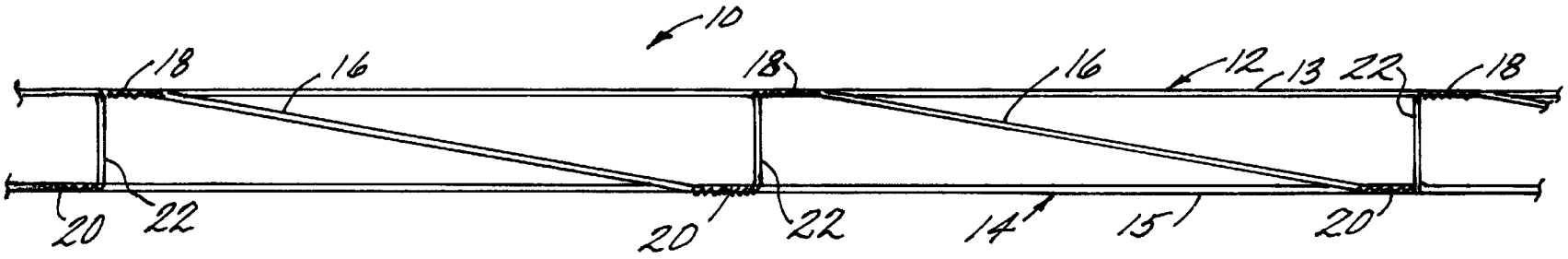
FIG. 1 is side view of a two tone woven cloth Venetian blind tape used in accordance with the present invention, wherein the threads within the cross-over area have been cut thereby allowing the vertical members to hinge open to form a Venetian blind ladder.
Figure 2:
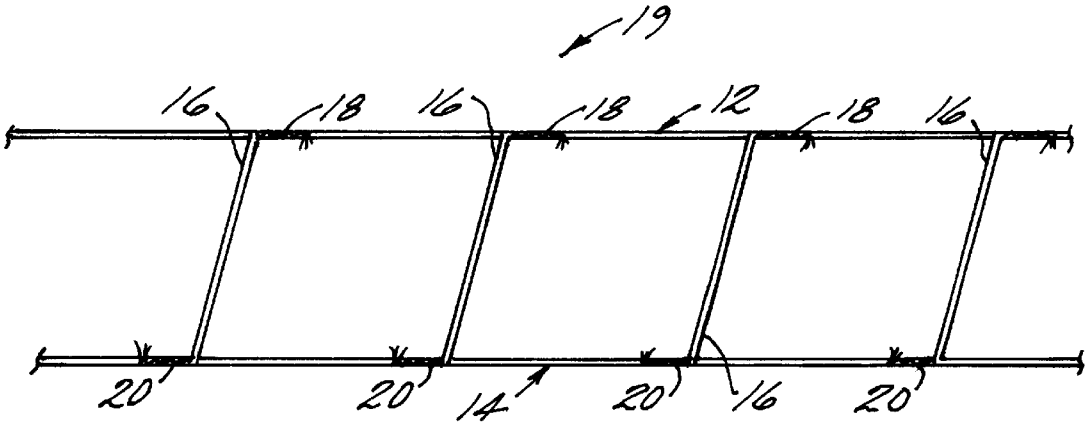
FIG. 2 is a side view of stock Venetian blind tape material used in accordance with the present invention, wherein the face fabric and back fabric are uncut.

Turning to FIGS. 1–2, the present invention is directed to a new and improved method for providing a two tone Venetian blind tape 10, wherein the Venetian blind tape 10 has two vertical members 12, 14. The vertical members comprise two shreds of narrow fabric weaving loom wherein the vertical member 12 is used as a face fabric, while the other vertical member is used as a back fabric 14 in constructing the Venetian blind tape. The outer surface 13 of face fabric or vertical member 12 is colored with a decorative color and/or pattern. The other vertical member or back fabric 14 of the Venetian blind tape 10 is of a light color or substantially white and is thus left in its natural color when the opposing vertical member 12 is colored with a decorative color(s) or pattern(s) in accordance with the method of the present invention. Back fabric 15 has an outer surface 15. In an alternative embodiment, the face fabric 12 and back fabric 14 are pre-dyed with a color and then a decorative pattern is applied onto the colored outer surface 13 of the face fabric 12. Face fabric 12 and back fabric 14 are preferably constructed of a synthetic material, more preferably polyester fibers. Although it is within the scope of this invention that other suitable synthetic and natural fabrics, such as cotton, may be used in the entire construction.

Cross-rung members 16 are woven into the face fabric 12 in a bind area 18 and are then allowed to float a predetermined distance before being woven into a bind area 20 of the back fabric 14, as illustrated in FIGS. 1 and 2. The distance between the face fabric 12 and the back fabric 14 is enlarged in FIG. 1, merely for illustration purposes. Cross-rung members 16 are composed on a plurality of separate string-like or threadlike strands which lie along side of one another and are interwoven with the vertical supporting members 12 and 14. The strands generally lie close to one another and often give the appearance of a single string rather than a plurality of strands. These cross-rung members 16 become the members in the Venetian blind assembly which support the slat material of the final Venetian blind.

As shown in FIG. 2, stock Venetian blind tape material is provided in accordance with the present invention and is generally indicated at 19. When the stock Venetian blind tape material 19 is produced using conventional weaving technology, the cross-rung members 16 are brought back up to the face fabric 12 after having been woven into the bind area 20 on the back fabric 14. By bringing the cross-rung members 16 back to the face fabric 12, the face fabric 12 and back fabric 14 are bound together at this point and the weaving process is then repeated to form the next cross-rung member 16 between the face fabric 12 and the back fabric 14. When the cross-rung members 16 are brought back to the face fabric 12 so that the next cross-rung member 16 may be created, this step creates a cross-over area 22 whereby cross-over threads bind the face fabric 12 together with the back fabric 14. The stock Venetian blind tape material 19 is manufactured by continuously weaving cross-rung yarns between the face fabric 12 and back fabric 14 to form cross-rung members 16. This results in a stock Venetian blind tape material 19 having vertical supporting members 12, 14 that are securely bound together by the cross-rung members 16 and by the cross-over threads 22. The cross-over threads 22 further strengthen the binding between the face fabric 12 and the back fabric 14 and provide essential dimensional stability to the Venetian blind tape.

Prior to cutting the cross-over threads 22, the stock Venetian blind tape material 19 is not functional because the cross-over threads 22 bind the face fabric 12 and back fabric 16 together and prevent the Venetian blind tape from being able to hinge open (as shown in FIG. 1) and thus provide the cross-rung members 16 which are necessary to support the slats of the Venetian blind.

Importantly, in accordance with the present invention, the stock Venetian blind tape material 19 is introduced to a thermal transfer printing station 34 (shown in FIG. 3) without the cross-over threads 22 being cut. Using stock Venetian blind tape material 19 is a key to holding the dimensional stability of the tape. By using stock Venetian blind tape material 19, the tape may be delivered to the thermal transfer printing station 34 and the desired decorative color and/or pattern may by applied to the outer surface 13 of face fabric 12 of the tape without the associated disadvantages which result when using Venetian blind tape material which has been cut prior to introduction to thermal transfer printing station 34. By providing stock Venetian blind tape material 19 to the thermal transfer printing station 34 with the cross-over threads 22 in tact, the following characteristics are observed: (1) any shrinkage that may occur is more uniform on both faces because they are 'connected', that is one face cannot move substantially without the other; (2) both tape faces will maintain a true path through the printing machine; and (3) keeping the tape in this true path (one face directly over the other) also keeps any ink from being transferred to parts of the back face. Tape that has been cut will have each face move independently and this could cause one face to be straight (true) while the other face can become skewed. Also because the print paper is wider than the tape being printed, the independent movement of the cut tape faces can allow the ink to be deposited onto the back face which is unsightly.

Maintaining the proper dimensional stability of the stock Venetian blind tape material 19 is also critical in the end use of the tape in a Venetian blind. The dimensions that are critical to end use are the following: length, width, and slant or bias. The length is a measurement representing the distance measured from a cross-rung to the next cross-rung, while the width represents the measurement between the face fabric 12 and back fabric 14 when the Venetian blind tape 10 has been cut and allowed to fully hinge open, as illustrated in FIG. 1. The slant or bias of the Venetian blind tape 10 may be tested by using the following test procedure: a length of tape, preferably six (6) feet, is mounted to a vertical board and held in place over a block that conforms to the dimensions of the tape. By using the block, it is insured that the top uppermost cross-rungs members 16 are perpendicular (90° angle) to the vertical members 12, 14 of the Venetian blind tape 10. A weight, preferably 250 g is hung from the bottom of each vertical member 12, 14 at the tape end opposite the block component. An inspection is conducted at approximately five (5) feet from the top of the six (6) foot tape, where it is determined whether there is any bias or slant in either direction. Bias or slant of the cross-rungs is the measurement taken of the difference of the measured cross-rung from the "ideal" cross-rung orientation of being perpendicular to the front and back faces. (If the top cross-rung is set perpendicular on the gauge block, then at the 5 foot point of measurement that cross-rung should remain perpendicular).

Figure 3:
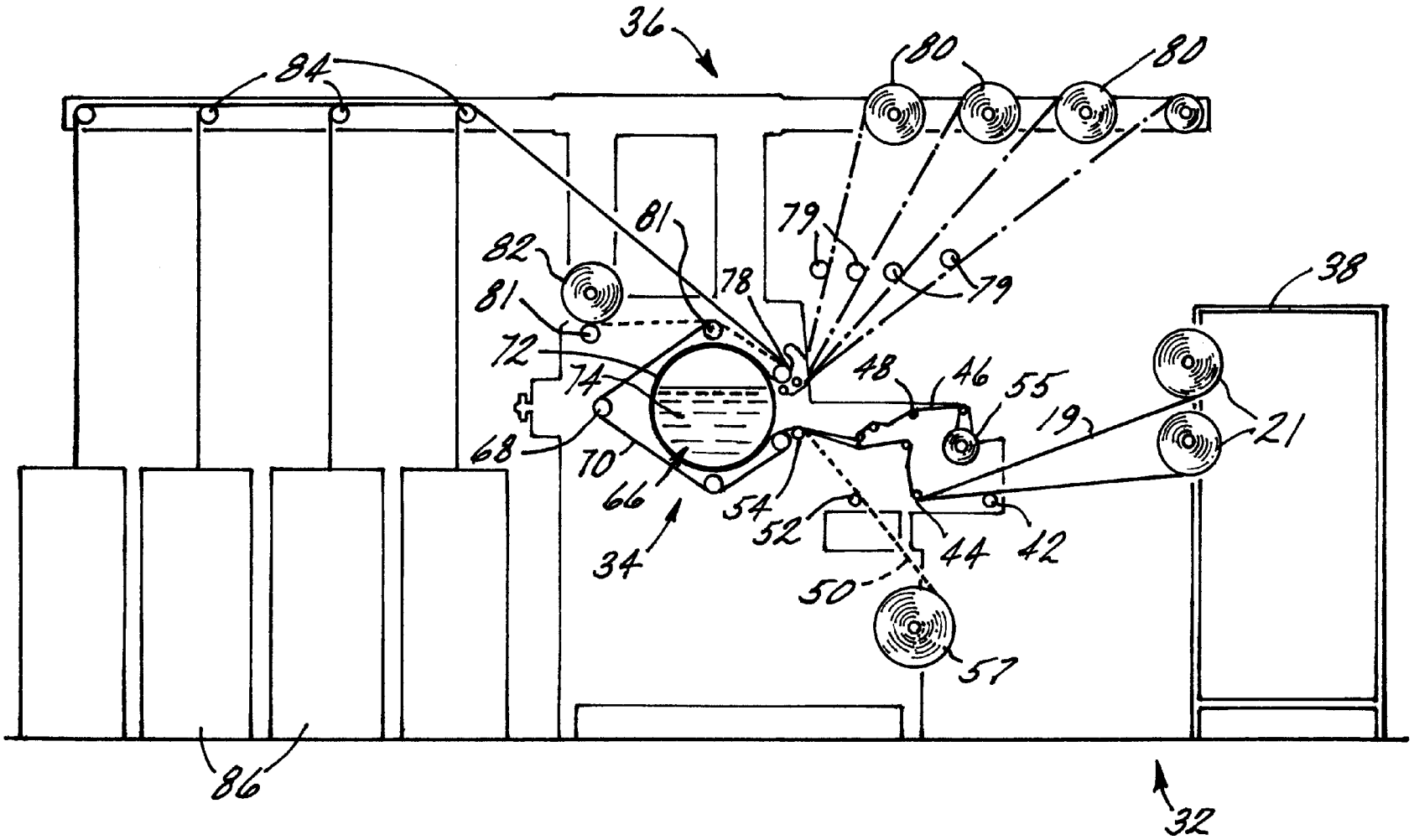
FIG. 3 is a side view of a thermal transfer printing apparatus used in accordance with the present invention to produce a two tone Venetian blind tape.
Figure 4:
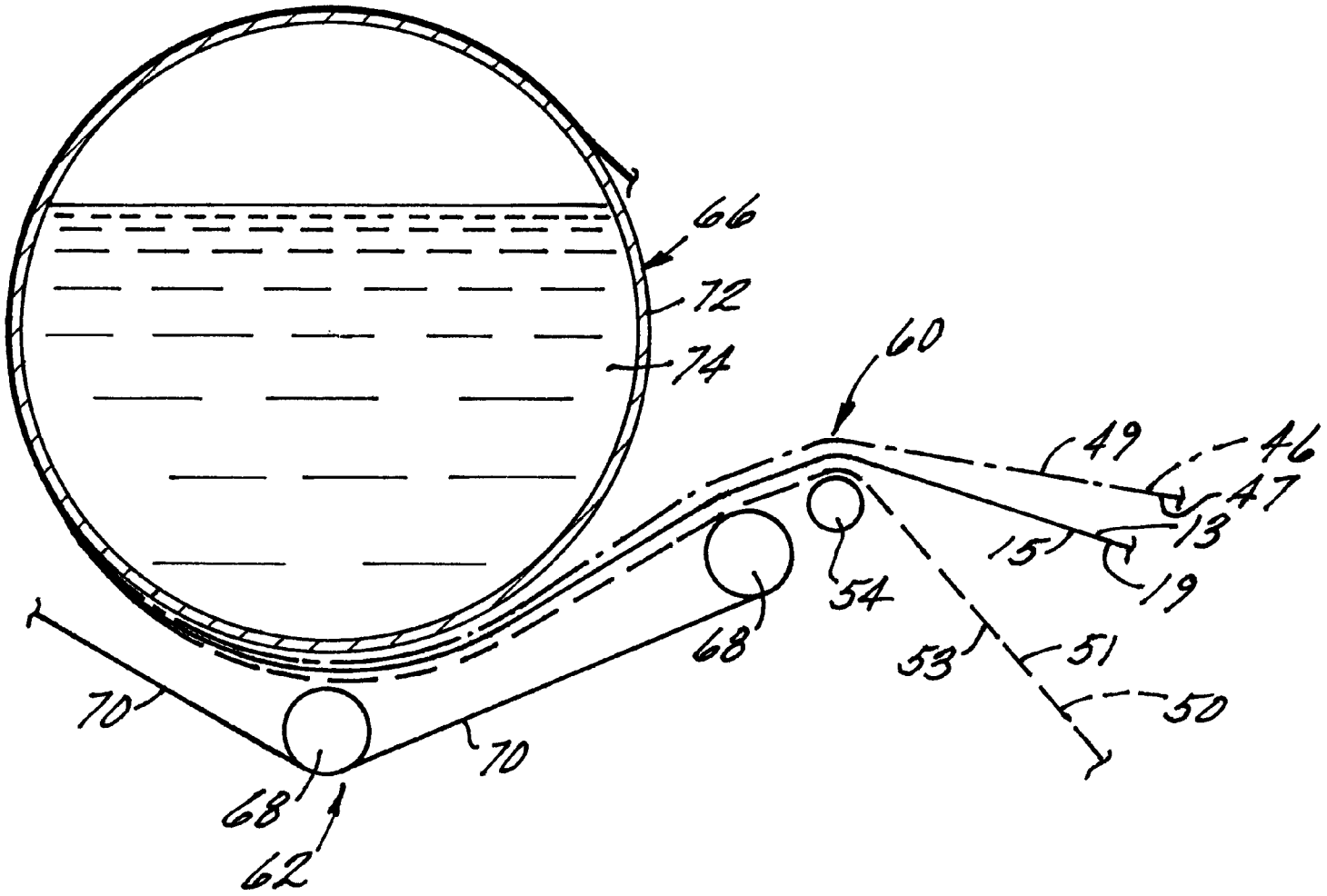
FIG. 4 is a side view of an enlarged portion of FIG. 3.

Turning to FIGS. 3–4, in accordance with the present invention, a thermal transfer printing assembly comprises at least one infeed station 32, a thermal transfer printing station 34, and at least one uptake station 36. The infeed station 32 comprises a work station 38 wherein stock Venetian blind tape material 19 is provided, preferably in the form of spooled rolls 21. The stock Venetian blind tape material 19 is positioned so that it is delivered to the thermal transfer printing station 34 by means of conventional rollers 44 and guide units 42 which are known in the manufacturing arts.

Heat sensitive printing paper 46 and protection paper 50 are also provided and delivered to the thermal transfer printing station 34. The heat sensitive printing paper 46 has an inner surface 47 and an outer surface 49 and the protection paper 50 also has an inner surface 51 and an outer surface 53. The heat sensitive printing paper 46 and protection paper 50 are generally provided on spooled rolls 55 and 57 respectively. The heat sensitive printing paper 46 and protection paper 50 are guided and delivered to the thermal transfer printing station 34 by means of a series of adjusted tension rollers 48, the use of which is known in the art.

As is known in the printing arts, heat sensitive printing paper 46 can contain a wide spectrum of background colors and/or decorative patterns on the inner surface 47 thereof and the inks forming the colors and decorative patterns in such heat sensitive printing paper 46 may be transferred to suitable fabrics by means of a thermal transfer process thereby effectively and efficiently coloring the fabric with a desired decorative color and/or pattern. The protection paper 50 is used to block the transfer of ink onto a belt-like member 70 of a drive belt assembly 62 which in turn will keep belt-like member 70 from contaminating clean stock Venetian blind tape material as it is driven by belt-like member 70. The protection paper 50 may be formed of tissue paper.

As illustrated in FIGS. 3 and 4, prior to being introduced into the thermal transfer printing station 34, the stock Venetian blind tape material 19, the heat sensitive printing paper 46, and protection paper 50 are brought together at intake roller 54. At intake roller 54, the heat sensitive printing paper 46 is disposed on the outer surface 13 of the face fabric 12 of stock material 19 and the protection paper 50 is disposed on the outer surface 15 of the back fabric 14 of the stock material 19 to form a layered structure generally shown by 60 (as best shown in FIGS. 2–4). More specifically, the inner surface 47 of the heat sensitive printing paper 46 is disposed on the outer surface 13 of face fabric 12 and inner surface 51 of protection paper 50 is disposed on the outer surface 15 of back fabric 14. Layered structure 60 is delivered to the drive belt assembly 62 of the thermal transfer printing station 34 by means of intake roller 54.

The thermal transfer printing station 34 comprises drive belt assembly 62 and a heat transfer drum 66. Any suitable heat transfer drum 66 may be used with the present invention, wherein the heat transfer drum 66 has an outer surface 72 for contacting the layered structure 60 as layered structure 60 is driven around outer surface 72 by drive-belt assembly 62.

In one embodiment, the heat transfer drum 66 comprises a smooth surfaced cylindrical drum having a sufficient amount of heating medium 74 within drum 66, wherein said heating medium 74 may be heated to a desired temperature by means of a conventional heating element (not shown). In a preferred embodiment, the heat transfer drum 66 comprises a smooth surfaced cylindrical metal drum having a sufficient amount of heating medium 74 within drum 66. A preferred heating medium 74 is a specially formulated oil for use in a thermal printing process. A preferred oil is commercially available from Exxon Corporation under the trade name Essotherm 500 and another preferred oil is commercially available from Mobil Oil Corporation under the trade name Mobiltherm 605. Not shown in the FIGURES is a conventional motor for driving the rotatably mounted heat transfer drum 66 and the drive belt assembly 62 and a controller for operating same.

The heat transfer drum 66 may be of any suitable dimension; however, in a preferred embodiment, the heat transfer drum 66 has a diameter of about 16 inches. The heating medium 74 within the heat transfer drum 66 transfers heat to the surface 72 of the drum 66 by being heated to a predetermined temperature so that an effective color transfer results between the heat sensitive printing paper 46 and stock material 19 when the two are placed in intimate contact and heat is applied to the outer surface 49 of heat sensitive printing paper 46. The temperature to which the heat transfer drum 66 is heated varies slightly according to factors including but not limited to the exact compositional make-up of the heat sensitive printing paper 46; the ink composition contained within the heat sensitive printing paper 46; and the speed of stock material 19 through the thermal transfer printing station 34 (time). A preferred temperature range is between about 200° and about 215° C.

Preferably, the heat transfer drum apparatus 66 also includes a controller (not shown) which permits the user to program the rate of rotation of the heat transfer drum 66. The rotation rate is selected in view of the desired contact time between the layered structure 60 and the heat transfer drum 66. Suitable contact times for an effective color transfer vary according to the make-up of the heat sensitive printing paper 46, the ink composition, the temperature of the heat transfer drum 66, and other factors which are known in the thermal transfer printing arts. A suitable rotation rate for the heat transfer drum 66 is 3–4 yards per minute and a suitable time for any given portion of the layered structure 60 to be in contact with the heat transfer drum 66 is between about 15 and about 20 seconds. In one embodiment, the controller may further include a temperature sensor that provides a signal to the controller representative of the temperature of the outer surface 72 of the drum 66.

The drive belt assembly 62 may comprise any suitable drive belt assembly known in the art. In a preferred embodiment, the drive belt assembly 62 comprises at least one roller 68 which drives a belt-like member 70.

The drive belt assembly 62 is provided around a portion of the outer surface 72 of the heat transfer drum 66 so that the layered structure 60 is driven around a portion of the outer surface 72 of the rotating heat transfer drum whereby the layered structure 60 remains in intimate contact with the outer surface 72 of the heat transfer drum 66 as it is driven, as illustrated in FIG. 3. Suitable power and control means to drive the belt assembly 62 include a conventional motor and controller (not shown), wherein the controller permits the user to program the speed of the drive belt assembly. In order for the layered structure 60 to be effectively driven around a portion of the outer surface 72 of the heat transfer drum 66 and remain in intimate contact with drum 66 without any sliding action resulting between the components of the layered structure 60, the drive belt speed should be set at the approximate rotation rate of the heat transfer drum 66.

The heat transfer drum 66 and the drive belt assembly 62 are operated so that the layered structure 60 is cleanly driven around a portion of the outer surface 72 of the heat transfer drum 66 without the layered structure 60 "buckling" or one fabric sliding relative to the other fabric as the layered structure is driven around the outer surface 72.

As the layered structure 60 is driven around a portion of the outer surface 72 of the heat transfer drum 66, it is important that the inner surface 47 of the heat sensitive printing paper 46 faces away from the outer surface 72 of the heat transfer drum 66. The intimate contact between the outer surface 72 of the heat transfer drum 66 and the layered structure 60 as the layered structure 60 is driven around the outer surface 72 activates the ink on the inner surface 47 of heat sensitive printing paper 46 and causes the ink to migrate from the inner surface 47 of the heat sensitive printing paper 46 to the outer surface 56 of the stock Venetian blind tape material 19. The thermal transfer of the inks contained on the inner surface 47 of the heat sensitive printing paper 46 allows the color or decorative pattern of the heat sensitive printing paper 46 to be duplicated on the outer surface 56 of the stock Venetian blind tape material 19.

After the layered structure 60 is driven around a portion of the outer surface 72 of the heat transfer drum 66 and the color and/or decorative pattern of the heat sensitive printing paper 46 is effectively transferred to the stock Venetian blind tape material 19, the layered structure 60 is directed to exit roller 78 where the layered structure 60 is separated back into its separate components, namely the heat sensitive printing paper 46, the stock Venetian blind tape material 19, and the protection paper 50. By using adjusted tension rollers and guide units which are known in the art, the layered structure 60 is broken down into its individual components. The components 19, 46, 50 are individually directed toward the uptake station 36.

The uptake station 36 comprises a plurality of uptake devices which receive the heat sensitive printing paper 46, the stock Venetian blind tape material 19, and the protection paper 50, respectively. In one embodiment, the heat sensitive printing paper 46 and the protection paper 50 are directed to spool rollers 80, 82 by means of adjusted tension rollers and conventional guide units 79, 81, respectively, wherein each is collected and gathered on individual spools. The used heat sensitive printing paper 46 is collected on rolling up devices 80 and the protection paper is collected on rolling up bar 82. Each material is conveniently spooled onto such rollers and may be removed when full capacity of the roller is realized or the user desires to change the heat sensitive printing paper 46 and/or the protection paper 50.

The stock Venetian blind tape material 19 with the desired color and/or decorative pattern applied to the outer surface 56 thereof may be directed by conventional adjusted tension rollers or guide units 84 to a suitable storage container 86 such as corrugated containers.

Turning to FIGS. 1–2, in an alternative embodiment of the present invention, the stock Venetian blind tape material 19 includes face fabric 12 and back fabric 14 which are colored prior to the stock Venetian blind tape material 19 being introduced to the thermal transfer printing station 34 (shown in FIG. 3). The face fabric 12 and back fabric 14 are pre-colored using a conventional dye process known in the arts. In this embodiment, a decorative pattern is applied to the colored outer surface 13 of face fabric 12 by the thermal transfer printing process described hereinbefore. In this embodiment, the colored face fabric 12 and back fabric 14 of the stock Venetian blind tape material 19 are preferably of the same color to correspond with the colored slats of a Venetian blind. In all other aspects, the colored stock material is identical to the color neutral stock material previously discussed herein with reference to FIGS. 1 and 2.

For the stock Venetian blind tape material 19 to become functional after the desired decorative color or pattern has been applied, the cross-over threads 22 of the stock material 19 are cut. The cutting of the cross-over threads 22 is accomplished by suitable cutting means known in the art. For example, the cross-over threads 22 may be manually cut by the user or the cross-over threads 22 may be cut by providing the colored stock material 19 to a mechanical cutting apparatus. The colored stock material 19 may be delivered to a cutting apparatus from the thermal transfer printing station 34 by conventional delivery means, such as a series of adjusted tension rollers and guide units.

In general, the preferred method of the present includes transferring a decorative color of pattern from heat sensitive printing paper to the stock Venetian blind tape material by application of heat from a thermal transfer printing process.

What is claimed is:

1. A method for applying a decorative color or pattern to a stock Venetian blind tape material, wherein the stock material comprises a face fabric, a back fabric, cross-rung members connecting the face fabric to the back fabric, and cross-over threads connecting the face fabric to the back fabric at predetermined areas, comprising the steps of:

applying a heat sensitive printing paper to the face fabric, wherein the heat sensitive printing paper includes a decorative color or pattern thereon;

applying a protection paper to the back fabric to form a layered structure wherein the stock Venetian blind tape material is disposed between the heat sensitive printing paper and the protection paper; and applying heat to the layered structure.

2. The method of claim 1, further comprising:

cutting the cross-over threads thereby allowing the face fabric and the back fabric to hinge open and thus provide the cross-rung members to support a plurality of slats of a venetian blind.

3. The method of claim 1, wherein the face fabric, the back fabric, the cross-rung members, and the cross-over threads are composed of a synthetic material.

4. The method of claim 3, wherein the synthetic material is woven polyester fibers.

5. The method of claim 3, wherein the face fabric and the back fabric form vertical supporting members of the Venetian blind tape; the face fabric having an outer surface for receiving a decorative color or pattern and wherein the cross-rung members provide support members for Venetian blind slats in an assembled Venetian blind.

6. The method of claim 5, wherein the cross-rung members comprise a plurality of string like or threadlike strands, wherein the cross-rung members are interwoven with the face fabric and the back fabric.

7. The method of claim 5, wherein the heat sensitive printing paper has an inner and outer surface, wherein a decorative color or pattern is provided on the inner surface.

8. The method of claim 7, wherein the heat sensitive printing paper is disposed on the outer surface of the face fabric of the stock Venetian blind tape material so that the inner surface of the heat sensitive printing paper is in intimate contact with the outer surface of the face fabric of the stock Venetian blind tape material.

9. The method of claim 1, wherein the protection paper comprises tissue paper.

10. The method of claim 1, wherein the applying of heat comprises transferring heat from a heat source to the layered structure.

11. The method of claim 10, wherein the heat source comprises a heat transfer drum having an outer surface and having a heating medium disposed within the drum.

12. The method of claim 11, wherein the heat transfer drum comprises a cylindrical metal drum having a smooth surface and the heating medium comprises an oil; wherein the outer surface of the heat transfer drum is maintained at a predetermined temperature.

13. The method of claim 12, wherein the predetermined temperature is between about 200° and about 215° C.

14. The method of claim 7, wherein the heat is applied to the outer surface of the heat sensitive printing paper thereby causing the decorative color or pattern on the inner surface to migrate onto the outer surface of the face fabric of the stock Venetian blind tape material.

15. The method of claim 1, wherein the application of heat to the layered structure permits transfer of the decorative color or pattern from the heat sensitive printing paper to the layered structure.

16. The method of claim 1, wherein the stock Venetian blind tape material is colored prior to application of a decorative pattern thereto.

17. The method of claim 16, wherein prior to providing the stock Venetian blind tape material, the material is colored using a dye process.

18. The method of claim 16, wherein the heat sensitive printing paper has an inner and outer surface, wherein the decorative pattern is provided on the inner surface and the heat sensitive printing paper is disposed on an outer surface of the face fabric of the stock Venetian blind tape material so that the inner surface of the heat sensitive printing paper is in intimate contact with the outer surface of the face fabric of the stock Venetian blind tape material.

19. The method of claim 16, wherein the application of heat to the layered structure permits transfer of the decorative pattern from the heat sensitive printing paper to the layered structure.

* * * * *